US007974549B2

(12) United States Patent
Aoki et al.

(10) Patent No.: US 7,974,549 B2
(45) Date of Patent: Jul. 5, 2011

(54) DEVELOPING DEVICE AND IMAGE FORMING APPARATUS

(75) Inventors: Takeshi Aoki, Nagano (JP); Katsumi Okamoto, Nagano (JP); Takatomo Fukumoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/685,840

(22) Filed: Jan. 12, 2010

(65) Prior Publication Data

US 2010/0209126 A1 Aug. 19, 2010

(30) Foreign Application Priority Data

Feb. 18, 2009 (JP) ..... 2009-034980

(51) Int. Cl.
*G03G 15/08* (2006.01)

(52) U.S. Cl. ..... 399/103; 399/43; 399/55; 399/279

(58) Field of Classification Search ..... 399/279, 399/285, 283, 53, 55, 265, 103, 43
See application file for complete search history.

(56) References Cited

U.S. PATENT DOCUMENTS

| | | | | |
|---|---|---|---|---|
| 5,387,967 | A | 2/1995 | Brewington et al. | |
| 7,324,775 | B2 | 1/2008 | Okamoto | |
| 2007/0147906 | A1 | 6/2007 | Sakurai et al. | |
| 2007/0177906 | A1 * | 8/2007 | Yamanaka et al. | 399/279 |
| 2008/0273901 | A1 | 11/2008 | Toyama et al. | |
| 2009/0110444 | A1 * | 4/2009 | Yamada et al. | 399/284 |
| 2009/0148197 | A1 * | 6/2009 | Yamada et al. | 399/284 |
| 2009/0290900 | A1 * | 11/2009 | Maeda et al. | 399/103 |

FOREIGN PATENT DOCUMENTS

| | | | |
|---|---|---|---|
| EP | 2056170 | A1 | 5/2009 |
| JP | 2005-292788 | A | 10/2005 |
| JP | 2007-140080 | | 6/2007 |
| JP | 2008-145562 | A | 6/2008 |

* cited by examiner

*Primary Examiner* — Sophia S Chen
(74) *Attorney, Agent, or Firm* — Global IP Counselors, LLP

(57) ABSTRACT

A developing device includes: a developing roller on the surface of which intersecting inclined grooves are formed by rolling working; and a seal member which comes into contact with the developing roller, wherein ridge portions of a convex portion surrounded by the inclined grooves of the surface of the developing roller are formed such that rotational resistance due to the contact of the seal member on the downstream side of a rotation direction opposite to a rotation direction of the developing roller at the time of development is larger than rotational resistance due to the contact of the seal member on the downstream side of a rotation direction of the developing roller at the time of development, and at the time of refreshing of the seal member, the developing roller is rotated in the opposite direction to a direction at the time of development.

6 Claims, 8 Drawing Sheets

DEVELOPING DEVICE AND IMAGE FORMING APPARATUS

BACKGROUND

1. Technical Field

The present invention relates to a developing device and an image forming apparatus.

2. Related Art

An image forming apparatus such as a laser beam printer is provided with a photo conductor as one example of a latent image supporting body for supporting a latent image, and a developing device which develops the latent image supported on the photo conductor by toner. In order to develop the latent image supported on the photo conductor, the developing device has a developing chamber, which has an opening and contains toner, and a developing roller which is provided facing the opening and supports toner. The latent image supported on the photo conductor is developed by the toner supported on the developing roller.

In the developing chamber which contains toner, a toner supply roller is disposed. The supply roller comes into contact with the developing roller so as to supply toner to the developing roller, and also, scrape off remaining toner from the developing roller after development. A regulating blade comes into contact with the developing roller so as to regulate the thickness of toner layer supported on the developing roller. A seal member comes into contact with the developing roller at a position passed over a development position, so as to allow movement of toner remaining on the developing roller into the developing chamber and regulate movement of toner in the developing chamber to the exterior of the developing chamber.

In JP-A-2005-292788, there is disclosed a developing device in which a developing roller for supporting toner and a seal member which comes into contact with the developing roller at a position passed over a development position in order to prevent leakage of toner by coming into contact with the developing roller are mounted on a developing chamber, and also, a support member for supporting the developing roller and the seal member, and a biasing member for biasing the seal member against the developing roller are provided.

In such a developing device, there is a case where as a printing time or the number of printing sheets increases, fixation of toner to a nip portion of the seal member and the developing roller occurs. Fixation of toner to the seal member becomes a cause of filming of the developing roller, so that a stripe is generated in an image, or leakage of toner from a seal portion is generated.

SUMMARY

An advantage of some aspects of the invention is that it provides a developing device which prevents fixation of toner to a nip portion of the seal member and the developing roller, thereby lengthening an operating life of the seal member, and consequently, being able to realize a longer operating life of the whole developing device, and an image forming apparatus provided with the developing device.

According to a first aspect of the invention, there is provided a developing device including: a developing roller on the surface of which intersecting inclined grooves are formed by rolling working; and a seal member which comes into contact with the developing roller, wherein ridge portions of a convex portion surrounded by the inclined grooves of the surface of the developing roller are formed such that rotational resistance due to the contact of the seal member on the downstream side of a rotation direction opposite to a rotation direction of the developing roller at the time of development is larger than rotational resistance due to the contact of the seal member on the downstream side of a rotation direction of the developing roller at the time of development, and at the time of refreshing of the seal member, the developing roller is rotated in the opposite direction to a direction at the time of development. A ridge portion means a portion at which a surface of a convex portion intersects with a flank of the convex portion. By the rotation of the developing roller in the opposite direction to a rotation direction at the time of development, toner fixed to a nip portion of the seal member can be removed by the ridge portion with high rotational resistance of the convex portion.

Further, in the developing device, burrs are formed on the ridge portions of the convex portion on the upstream side of the rotation direction of the developing roller at the time of development. By the rotation of the developing roller in the opposite direction to a rotation direction at the time of development, toner fixed to a nip portion of the seal member can be removed by the burrs formed on the ridge portion of the convex portion.

Further, in the developing device, an angle that a surface of the convex portion makes with a flank of the convex portion on the downstream side of the rotation direction of the developing roller at the time of development is formed to be smaller than an angle that a surface of the convex portion makes with a flank of the convex portion on the upstream side of the rotation direction of the developing roller. By the rotation of the developing roller in the opposite direction to a rotation direction at the time of development, toner fixed to a nip portion of the seal member can be removed by an edge portion in which an angle that a surface of the convex portion makes with a flank of the convex portion is large.

Further, in the developing device, the refreshing of the seal member is carried out when at least one of the conditions of a given printing time, a given number of printing sheets, the duration time of printing with high printing duty ratio, and the time of exchange of a toner cartridge has been reached. The refreshing of a nip portion of the seal member can be carried out before the generation of toner fixation to the seal member.

Further, in the developing device, data of each of the conditions is stored in a memory section of a printer main body or a memory section built in the toner cartridge. Before reaching a limit value at which toner fixation to the seal member is generated, warning is given to a user, and the refreshing of a nip portion of the seal member can be carried out.

Further, in the developing device, a range of the inverse rotation of the developing roller in a state where a developing bias is applied to the developing roller is set to be from a contact position of the seal member with the developing roller up to a contact position of a regulating blade with the developing roller. Toner removed by the refreshing of the seal member can be flied to a photo conductor and treated.

Further, in the developing device, a range of the inverse rotation of the developing roller in a state where a developing bias is not applied to the developing roller is set to be a range which is over a contact position of a regulating blade with the developing roller. Toner removed by the refreshing of the seal member is transported in the groove of the developing roller, and toner protruded from the groove is scraped off by the regulating blade, so that toner removed by the refreshing of the seal member is prevented from being returned to a developing chamber.

According to a second aspect of the invention, there is provided an image forming apparatus including: a latent image supporting body on which an electrostatic latent image is formed; a developing device which develops the electrostatic latent image by toner, thereby developing a toner image on the latent image supporting body; and a transfer device which transfers the toner image of the latent image supporting body to a transfer medium, wherein the developing device is any one of the developing devices described above. Generation of toner fixation to a nip portion of the seal member is suppressed by the refreshing of the seal member, so that the lowering of quality of an image can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
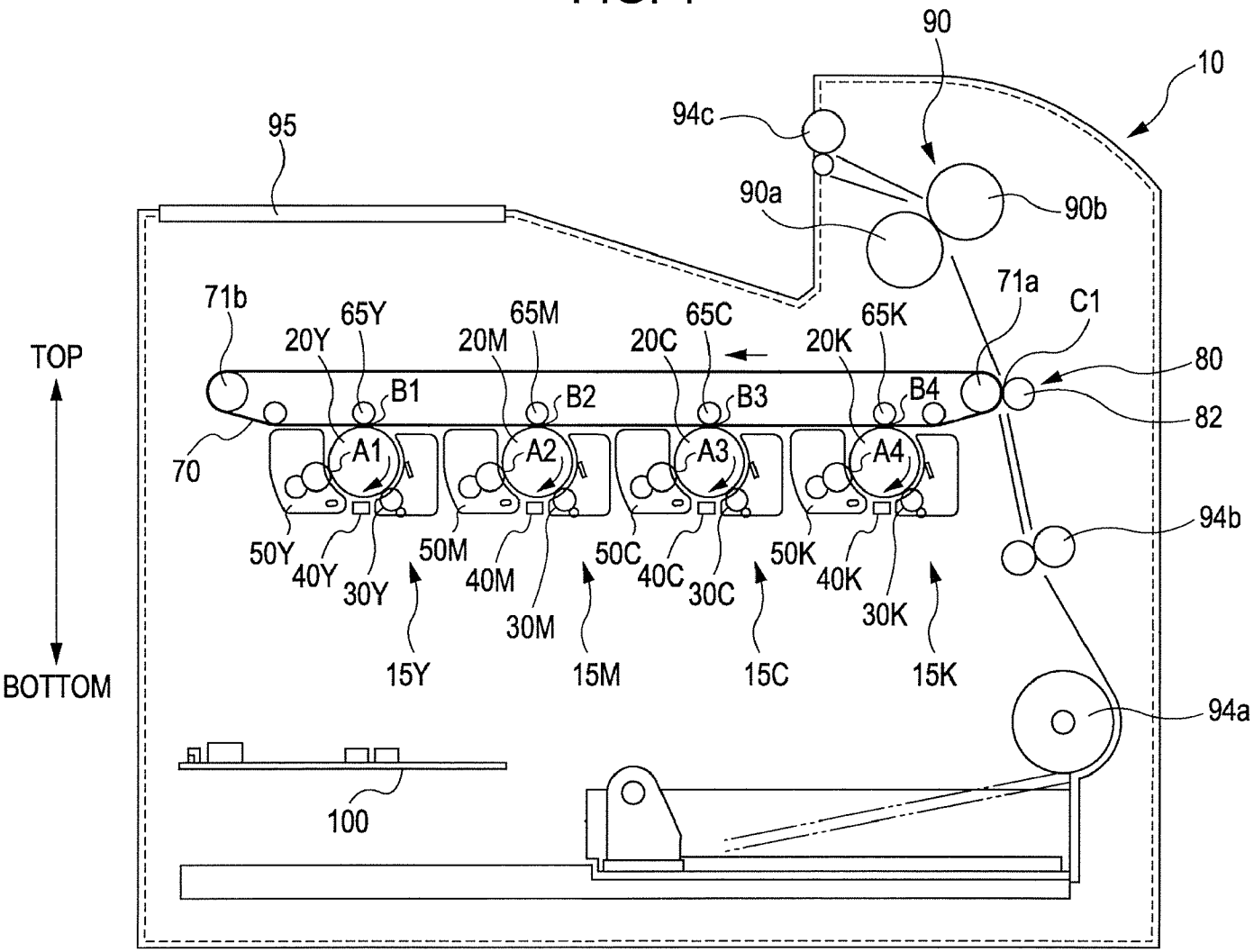
FIG. 1 is a view schematically showing one example of an embodiment of an image forming apparatus of the invention.

Hereinafter, embodiments of the invention will be explained based on the drawings. FIG. 1 is a view schematically showing one example of an embodiment of an image forming apparatus of the invention.

As shown in FIG. 1, an image forming apparatus 10 has four image forming stations 15Y, 15M, 15C, and 15K, an intermediate transfer belt 70, a secondary transfer unit 80, a fixing unit 90, a display unit 95 constituted by a liquid crystal panel, and a control unit 100 which controls these units and so on, thereby administering operation as the image forming apparatus.

The image forming stations 15Y, 15M, 15C, and 15K respectively have the function of forming an image by toner of yellow (Y), magenta (M), cyan (C), and black (K). Since the image forming stations 15Y, 15M, 15C, and 15K have the same configuration, only the image forming station 15Y will be explained below.

The image forming station 15Y (15M, 15C, or 15K) has an electrification unit 30Y (30M, 30C, or 30K), an exposure unit 40Y (40M, 40C, or 40K), a developing unit 50Y (50M, 50C, or 50K), and a primary transfer unit along the rotation direction of a photo conductor 20Y which is one example of an image supporting body, as shown in FIG. 1.

The photo conductor 20Y has a base material of a cylindrical shape and a photosensitive layer formed on the outer circumference surface of the base material, is rotatable about a central shaft, and, in this embodiment, rotates in the clockwise direction, as indicated by an arrow.

The electrification unit 30Y is a device for electrifying the photo conductor 20Y. A latent image is formed on the electrified photo conductor 20Y by irradiating a laser from the exposure unit 40Y.

The exposure unit 40Y has a semiconductor laser, a polygon mirror, an F-θ lens, and the like and irradiates the electrified photo conductor 20Y with a modulated laser on the basis of an image signal input from a host computer (not shown) such as a personal computer or a word processor.

The developing unit 50Y is a device for developing the latent image formed on the photo conductor 20Y by using toner of yellow (Y). In the developing unit 50Y, a developing roller 51Y and a supply roller 52Y are disposed in a developing chamber to which toner is supplied from an exchangeable toner cartridge, and the toner on the developing roller 51Y is thinned by bringing a regulating blade 53Y into contact with the developing roller 51Y.

In the primary transfer unit, a primary transfer bias is applied by a primary transfer roller 65Y (65M, 65C, or 65K) at a primary transfer section B1, so that a yellow toner image formed on the photo conductor 20Y is transferred to the intermediate transfer belt 70. In a case where toners of four colors have been sequentially transferred with layers at the respective primary transfer sections B1, B2, B3, and B4, a full-color toner image is formed on the intermediate transfer belt 70.

The intermediate transfer belt 70 is an endless belt mounted to pass around a belt driving roller 71*a* and a driven roller 71*b*, and is rotationally driven while coming into contact with the photo conductor 20Y, 20M, 20C, and 20K.

The secondary transfer unit 80 is a device for transferring a monochromatic toner image or a full-color toner image formed on the intermediate transfer belt 70 to a transfer material such as paper, film, or cloth.

The fixing unit 90 is a device which is constituted by a fixing roller 90*a* and a pressing roller 90*b* and fuses and bonds the monochromatic toner image or the full-color toner image transferred to the transfer material, to the transfer material, thereby obtaining a permanent image.

Next, operation of the image forming apparatus 10 constituted as described above will be explained. First, if an image signal and a control signal from a host computer (not shown) is input to a main controller of the image forming apparatus through an interface, the photo conductor 20Y, the developing roller 51Y provided in the developing unit 50Y, the intermediate transfer belt 70, and so on are rotated by the control of a unit controller based on the command from the main controller. The photo conductor 20Y is electrified in succession by the electrification unit 30Y at an electrification position while being rotated.

The electrified region of the photo conductor 20Y reaches an exposure position in accordance with the rotation of the photo conductor 20Y, and a latent image according to image information of yellow Y is formed on the region by the exposure unit 40Y.

The latent image formed on the photo conductor 20Y reaches a development position A1 (A2, A3 or A4) in FIG. 1 in accordance with the rotation of the photo conductor 20Y and is developed by the developing unit 50Y. In this way, a toner image is formed on the photo conductor 20Y.

The toner image formed on the photo conductor 20Y reaches a position of the primary transfer section B1 in accordance with the rotation of the photo conductor 20Y and is transferred to the intermediate transfer belt 70 by the primary transfer unit. At this time, in the primary transfer unit, a primary transfer voltage having the opposite polarity to the electrification polarity of toner is applied from the primary transfer roller 65Y. As a result, the toner images of four colors formed on the respective photo conductor 20Y, 20M, 20C, and 20K are transferred with an overlap to the intermediate transfer belt 70, so that a full-color toner image is formed on the intermediate transfer belt 70.

The intermediate transfer belt 70 is driven by the driving force from a belt driving section such as a motor, which is transmitted through the belt driving roller 71*a*.

The full-color toner image formed on the intermediate transfer belt 70 is transferred to a transfer material such as paper by a transfer roller 82 of the secondary transfer unit 80 at a transfer section C1. The transfer material is transported from a paper feed tray to the secondary transfer unit 80 through a paper feed roller 94*a* and a resist roller 94*b*.

The full-color toner image transferred to the transfer material is heated and pressed by the fixing unit 90, thereby being fused and bonded to the transfer material. After passed over the fixing unit 90, the transfer material is discharged by a paper discharge roller 94*c*.

On the other hand, the photo conductor 20Y, 20M, 20C, and 20K, after passed over positions of the primary transfer section B1, B2, B3, and B4, are subjected to a process for removing electrical charge by a static elimination unit (not shown) and prepare for electrification for forming a next latent image.

An intermediate transfer belt cleaning device (not shown) is disposed on the driven roller 71*b* side of the intermediate transfer belt 70, in which secondary transfer has been ended, so as to clean the intermediate transfer belt 70, in which secondary transfer has been ended.

Figure 2:
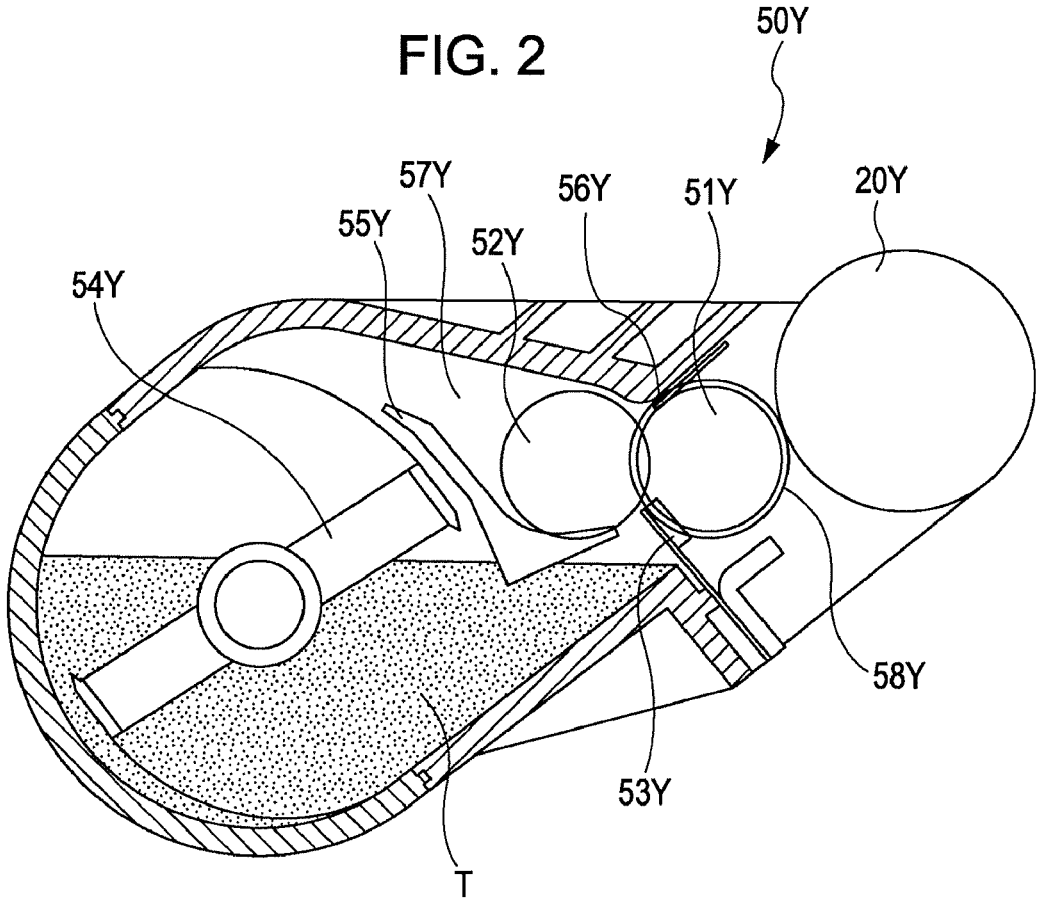
FIG. 2 is a schematic diagram showing one example of a developing unit.
Figure 3:
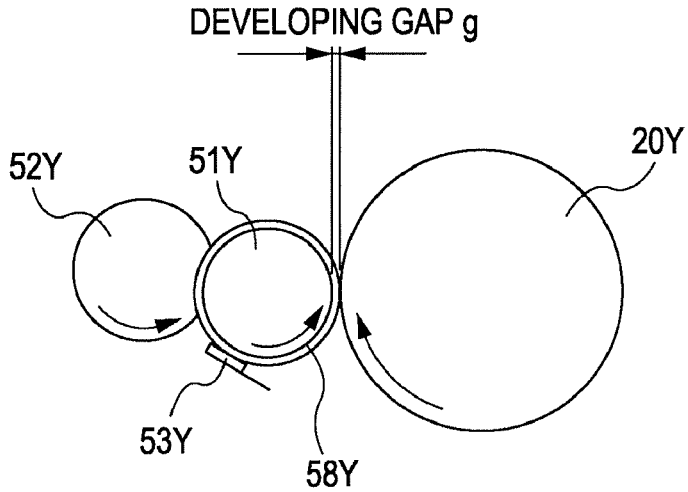
FIG. 3 is a partial diagrammatic view of the developing unit.

FIG. 2 is a schematic diagram showing one example of the developing unit 50Y of the invention, and FIG. 3 is a partial diagrammatic view of the developing unit 50Y of this example.

The developing unit 50Y includes the developing roller 51Y which transports toner T to the photo conductor 20Y, the supply roller 52Y which comes into pressure-contact with the developing roller 51Y so as to supply the toner T to the developing roller, the regulating blade 53Y which comes into pressure-contact with the developing roller 51Y so as to regulate the toner T which is transported to the photo conductor 20Y, a toner agitation and transport member 54Y which agitates and transports toner T, a toner receiving member 55Y which receives the toner T transported by the toner agitation and transport member 54Y and guides it to the supply roller 52Y, a seal member 56Y which comes into contact with the developing roller 51Y in the direction of recovering the toner T remained after development, and thus, prevent the leakage of toner, and a developing chamber 57Y which contains the toner T.

The developing roller 51Y is formed into a cylindrical shape by using an electrically conductive material such as metal or alloy including iron, copper, aluminum, stainless steel, or the like. The supply roller 52Y is formed into a cylindrical shape by using an elastic material such as foamed urethane rubber or silicone rubber, or formed by wrapping a cylindrical body with a hair-implanted sheet. The developing roller 51Y and the supply roller 52Y rotate in contact with each other, so that the toner T is supplied onto the developing roller 51Y, whereby a toner layer of a given thickness is formed on the developing roller 51Y. The regulating blade 53Y comes into contact with the developing roller 51Y supplied with the toner T, so that the thickness of the toner layer on the developing roller 51Y is regulated. The toner is applied with an electric charge by frictional electrification on the developing roller 51Y.

As shown in FIG. 3, a spacer 58Y is fixed to each of the opposite ends of the developing roller 51Y. These spacers 58Y are brought into pressure-contact with the image non-supporting surfaces of the photo conductor 20Y, so that a developing gap g is formed between a toner transporting surface of the developing roller 51Y and an image supporting surface of the photo conductor 20Y, which faces the toner transporting surface.

Then, the developing gap g is adjusted to a desired size by appropriately selecting the thicknesses of the spacers 58Y. Thus, this developing device is configured so as to perform nonmagnetic mono-component developer non-contact jumping development using the toner T which is nonmagnetic mono-component developer. In this case, in this example, setting is made such that the photo conductor 20Y rotates in the clockwise direction, and also, both the developing roller 51Y and the supply roller 52Y rotate in the counter-clockwise direction. Also, setting is made such that the circumferential velocity of the photo conductor 20Y and the circumferential velocities of the spacers 58Y on the developing roller 51Y are the same or approximately the same. Further, in this embodiment, a non-contact type developing method is explained, but a contact type developing method may also be used.

Figure 4:
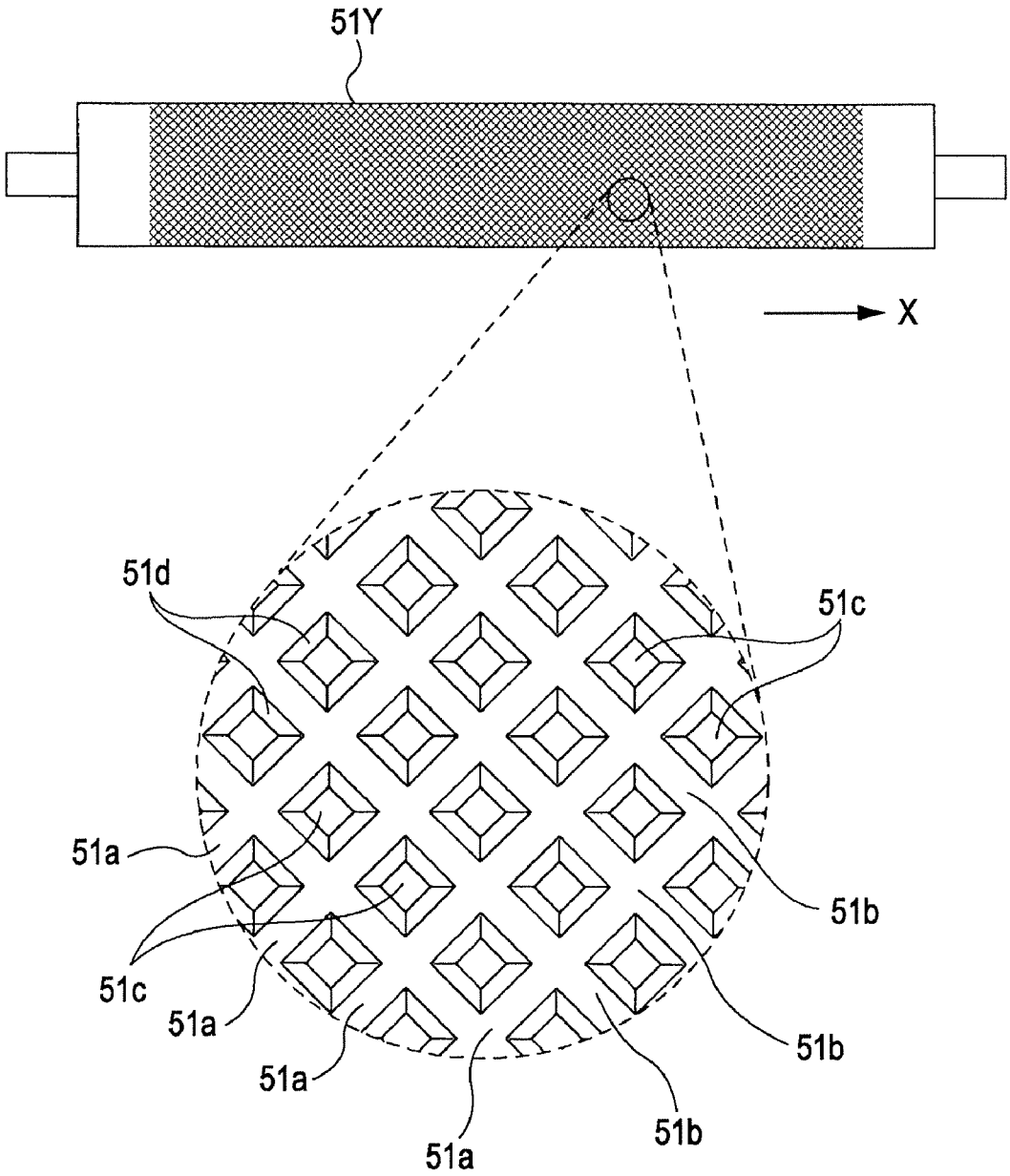
FIG. 4 is a view showing a developing roller and one example of an enlarged view of a portion of the surface thereof.

FIG. 4 is a view showing the developing roller of the invention and one example of an enlarged view of a portion of the surface thereof, and an enlarged view of a portion (in the circle of a dotted line) of FIG. 3 is an enlarged view of the surface portion of the developing roller 51Y of this example.

In order to improve the transportability and the electrification ability of the toner, a first inclined groove 51*a*, which is continuous in a helical shape inclined at a given angle with respect to an axial direction X and a circumferential direction, and a second inclined groove 51*b*, which is continuous in a helical shape inclined with respect to the axial direction and the circumferential direction in the direction opposite to that of the first inclined groove 51*a*, are formed so as to intersecting with each other in the surface of the developing roller 51Y. In addition, quadrangle convex portions 51*c* having flanks 51*d* are formed surrounded by the first inclined groove 51*a* and the second inclined groove 51*b*. In the developing roller 51Y of the invention, a regulating method is adopted in which toner is transported mainly in the groove portions of the first and second inclined grooves 51*a* and 51*b* formed in the surface of the developing roller. Since the developing roller 51Y is formed of an electrically conductive material such as metal or alloy including iron, copper, aluminum, stainless steel, or the like, an image force acts between the roller and the electrified toner which is transported in the groove, so that the toner is stably transported up to a developing nip. Further, if toner of a small grain diameter, where the volume average grain diameter is equal to or less than 5 μm, is used as the toner, the image of a higher image quality can be obtained, and in addition, since toner of a small grain diameter has higher electrification ability compared with toner of a larger grain diameter, such a toner is suitable for the regulating method in which toner is transported mainly in the groove. In addition, nickel plating, chrome plating, or the like may also be carried out on the surface of the developing roller 51Y, if necessary. Also, it is preferable to use toner with an average degree of circularity of 0.95 to 0.99, preferably 0.972 to 0.983. In this way, the electrification amount can be stable, and also, transportability can also be excellent. As a method of adjusting the degree of circularity of toner, in an emulsion polymerization method, by controlling the temperature and the time in the cohesion process of secondary particles, the degree of circularity can be freely changed and made in the range of 0.94 to 1.00. In a suspension polymerization method, the preparation of the true-spherical toner is possible, so that the degree of circularity can be made in the range of 0.98 to 1.00. In order to make an average degree of circularity in the range of 0.95 to 0.99, the degree of circularity can be appropriately adjusted by heating and deforming of toner at a temperature equal to or more than the Tg temperature of the toner.

Figure 5:
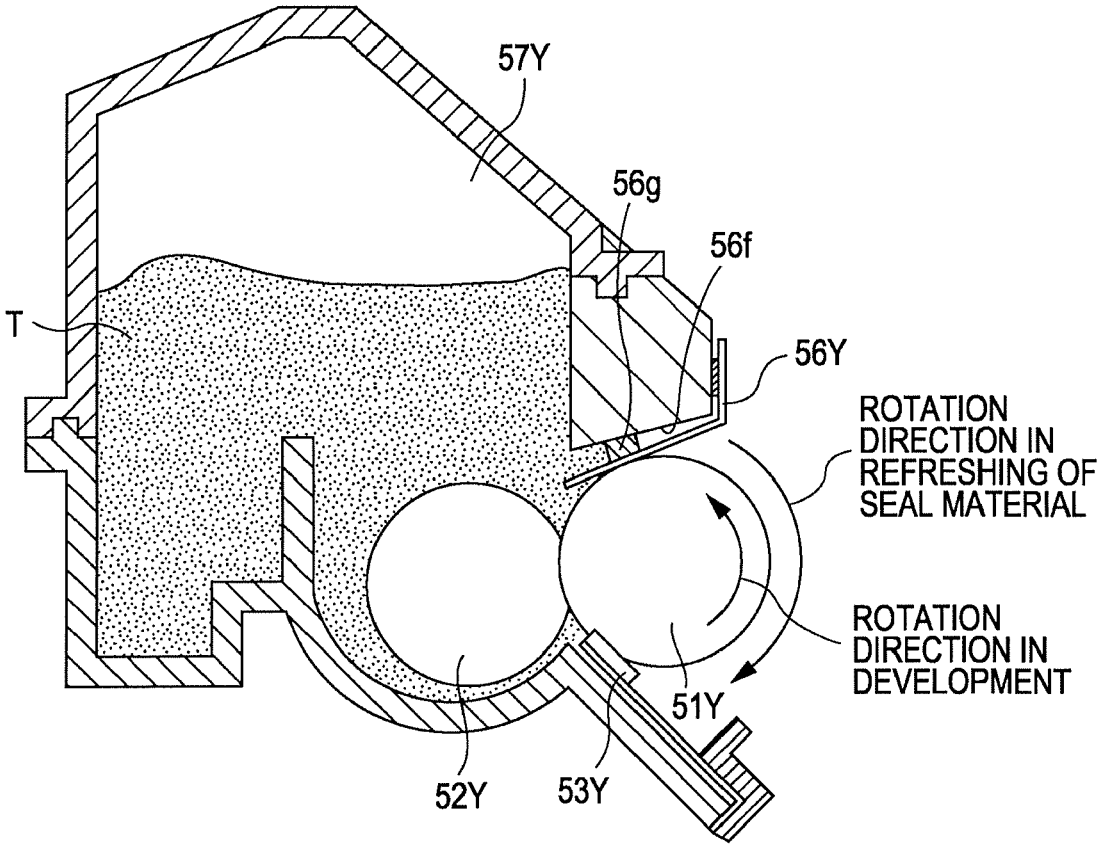
FIG. 5 is a view showing the arrangement of a seal member of the developing unit.

FIG. 5 is a view showing an arrangement state of the seal member 56Y of the developing unit of the invention.

The seal member 56Y, which comes into contact with the developing roller 51Y at a position passed over a development position, is formed of a resin film such as polyethylene or polytetrafluoroethylene. In order to bring the seal member 56Y into contact with the developing roller 51Y at a given contact pressure, a backup member 56*g* made of an elastic material such as a sponge is supported by a support member 56*f* on the inside of the seal member 56Y. By making the thickness of the backup member 56*g* made of an elastic material larger than the distance between the support member 56*f* and the surface of the developing roller 51Y, the backup member 56*g* is compressively deformed so as to bring the seal member 56Y into contact with the developing roller 51Y at a given contact pressure, thereby forming a nip portion.

As a printing time, the number of printing sheets, or the duration time of printing with high printing duty ratio increases, fixation of toner to a nip portion of the seal member and the developing roller occurs. Fixation of toner to the seal member becomes a cause of filming of the developing roller, so that a stripe is generated in an image, or leakage of toner from a seal portion is generated.

Figure 6:
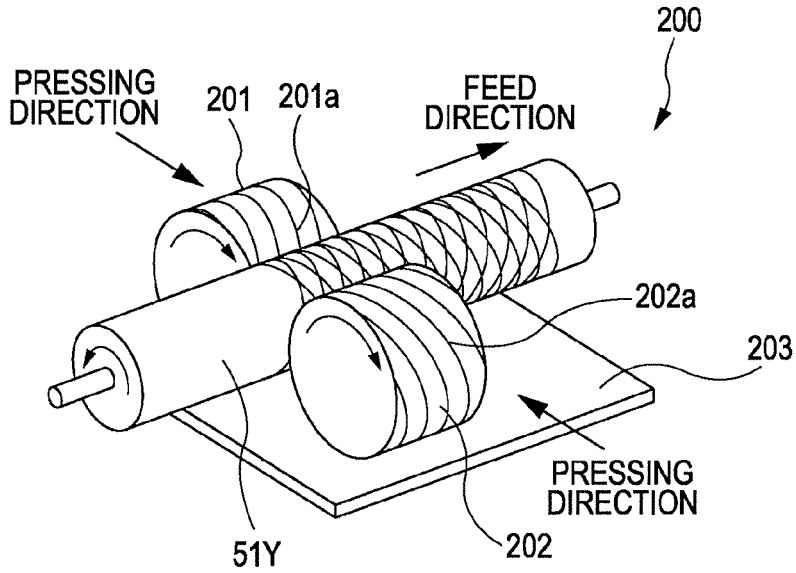
FIG. 6 is a view showing a rolling apparatus which forms intersecting inclined grooves in the developing roller.

FIG. 6 is a view showing a rolling apparatus 200 which works by rolling the intersecting inclined grooves in the surface of the developing roller 51Y for refreshing the seal member 56Y before the generation of toner fixation to the nip portion of the seal member 56Y.

The rolling apparatus 200 used in the rolling working includes a first die 201 which has first inclined blades 201*a* inclined with respect to an axial direction and a circumferential direction, for forming the first inclined groove 51*a* in the developing roller 51Y; a second die 202 which has second inclined blades 202*a* inclined with respect to an axial direction and a circumferential direction in the direction opposite to that of the first inclined blade 201*a*, for forming the second inclined groove 51*b* in the developing roller 51Y; and a guide pedestal 203 disposed below the first die 201 and the second die 202.

The rolling apparatus 200 transports and works by rolling a work piece (here, an unprocessed developing roller 51Y) between the first die 201 and the second die 202, which are disposed to face each other and rotate in the clockwise direction, as indicated by an arrow, and the guide pedestal 203. In the rolling working, a working pressure is applied by pressing the first and second dies 201 and 202 against the work piece. The work piece is worked by rolling by rotating it in the counter-clockwise direction opposite to the rotation direction of the first and second dies 201 and 202. The work piece may also be worked by rolling by rotating the first and second dies 201 and 202 in the counter-clockwise direction and rotating the work piece in the clockwise direction.

The first and second inclined blades 201*a* and 202*a* for forming the above-described first and second inclined grooves 51*a* and 51*b* are respectively provided in the first die 201 and the second die 202. The first and second inclined blades 201*a* and 202*a* form the first and second inclined grooves 51*a* and 51*b* intersecting with each other, and the convex portions 51*c* of a truncated four-sided pyramid shape having the inclined flanks 51*d*, in the surface of the work piece.

The shape of the convex portion 51*c* of a truncated four-sided pyramid shape presents a square shape in a case where the inclined angles of the first and second inclined grooves 51*a* and 51*b* are 45° and the pitches of them are set to be the same as each other, and a rhombic shape in a case where the inclined angles of the first and second inclined grooves 51*a* and 51*b* are angles other than 45° and the pitches of them are set to be the same as each other. Also, the shape of the quadrangle convex portion 51*c* presents a rectangular shape in a case where the inclined angles of the first and second inclined grooves 51*a* and 51*b* are 45° and the pitches of them are set to be different from each other, and a parallelogram shape in a case where the inclined angles of the first and second inclined grooves 51*a* and 51*b* are angles other than 45° and the pitches of them are set to be different from each other.

Further, in the rolling working, by making the first and second dies 201 and 202 be not brought into contact with the opposite ends of the work piece, smooth surfaces without concavity-convexity remain on the opposite ends. That is, the convex portions 51*c* which have not been brought into contact with the first and second dies 201 and 202 at the central portion of the developing roller 51Y, and the opposite ends, which do not become objects to be worked by the rolling working, become the non-processed surfaces.

Figure 7:
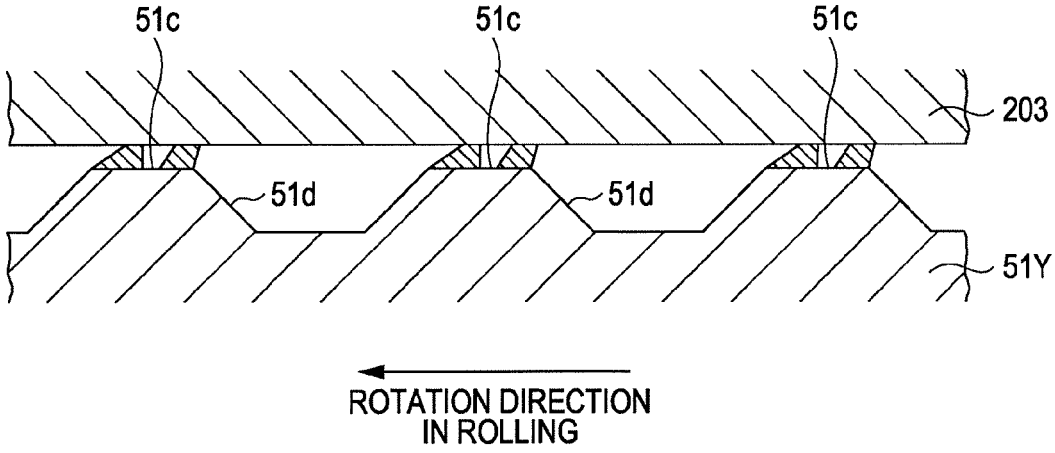
FIG. 7 is a view showing a state where burrs are formed in ridge portions of a convex portion of the surface of the developing roller.

In the rolling working, the first inclined blades 201*a* of the first die 201 and the second inclined blades 202*a* of the second die 202 do not positively cut the work piece, but act to form depressed areas by crushing the work piece by a suppressing force. Therefore, as shown in FIG. 7, embossed portions are formed on the ridge portions of the convex portion 51*c* of a truncated four-sided pyramid shape, which is surrounded by the first and second inclined grooves 51*a* and 51*b* which are formed after the rolling working. The embossed portions which are formed on the ridge portions of two sides which are located on the upstream side of the rotation direction (the rear side of the rotation direction) in the rolling working of the work piece are crushed by the guide pedestal 203, so that burrs 51*e* are formed which protrude from the ridge portions to the outside (from the ridge lines of the convex portion 51*c* to the groove portion side on the upstream side of the rotation direction in the rolling working of the work piece). Although the embossed portions are also formed on the ridge portions on the downstream side of the rotation direction (the front side of the rotation direction), since the embossed portions on the downstream side are crushed on the upper surface of the convex portion 51*c*, they do not protrude to the outside of the ridge portions.

Figure 8:
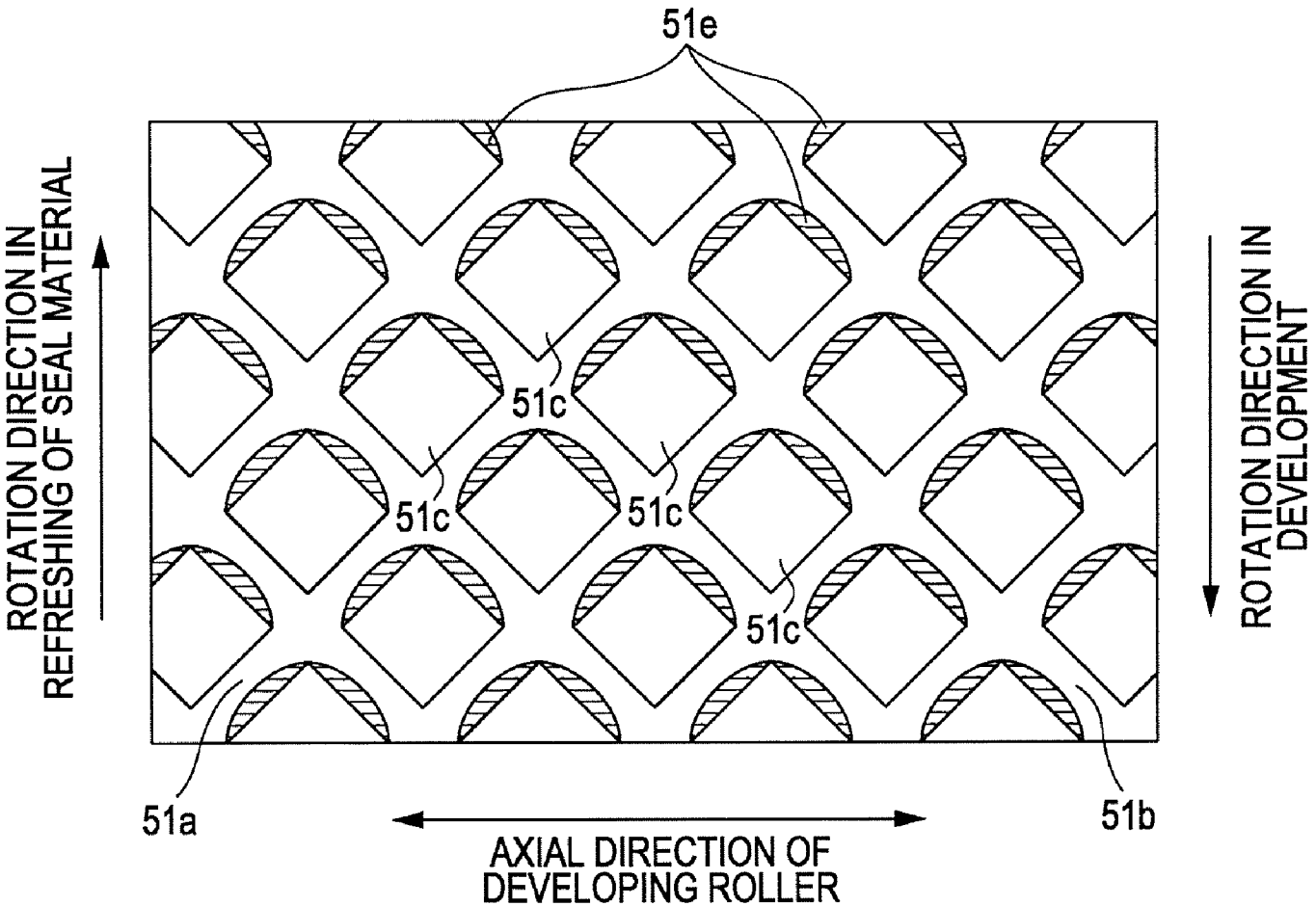
FIG. 8 is a view showing a positional relation between the rotation direction of the developing roller and a burr.

FIG. 8 is a view showing the formation places of the burrs 51*e* when the developing roller 51Y has been worked by rolling, and the rotation direction of the developing roller. As shown in FIG. 8, the burrs 51*e* are formed on the ridge portions on the upstream side of the rotation direction (the rear side of the rotation direction) of the developing roller 51Y at the time of development.

Figure 9A:
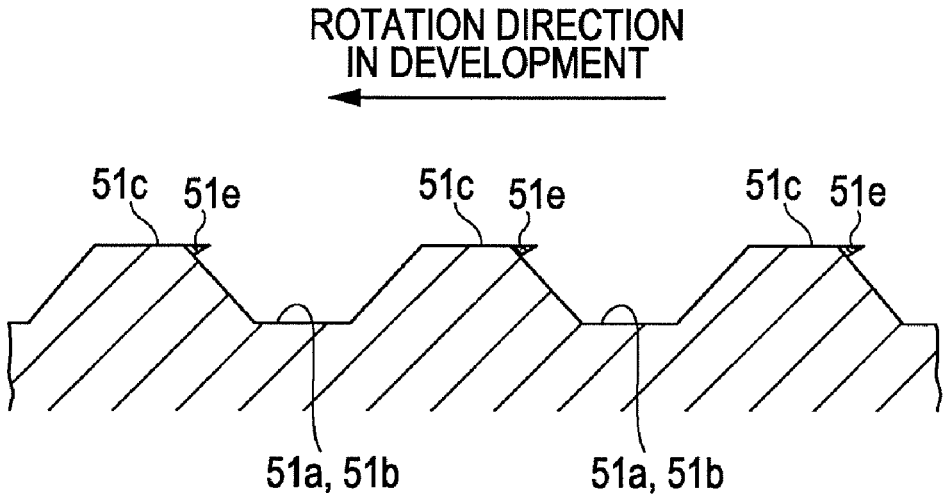
FIGS. 9A and 9B are views showing a state where fixed toner is removed by a burr.
Figure 9B:
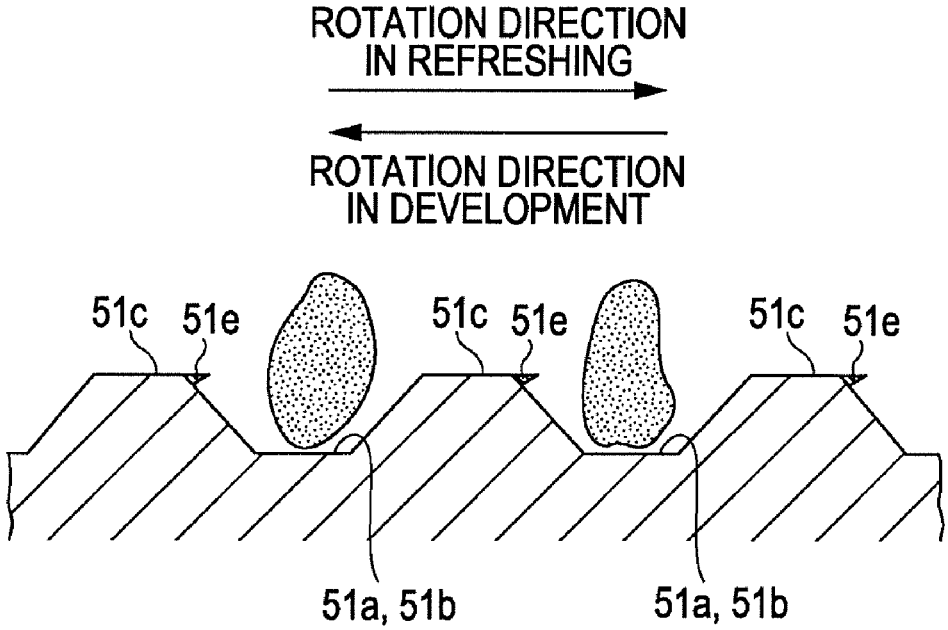

FIGS. 9A and 9B are views showing a first embodiment of the refreshing of the seal member.

The first embodiment of the refreshing of the seal member 56Y utilizes the burrs 51*e* formed on the ridge portions. Since the burrs 51*e* are not formed on the ridge portions on the downstream side of the rotation direction (the front side of the rotation direction) of the developing roller 51Y at the time of development, the seal member 56Y which comes into contact with the developing roller 51Y is brought into contact with it from the ridge portions on which the burrs 51*e* are not formed, so that rotational resistance of the developing roller 51Y due to the contact of the seal member 56Y is small.

For the refreshing of the seal member 56Y, the developing roller 51Y is rotated in the opposite direction to the rotation direction at the time of development. The seal member 56Y which comes into contact with the developing roller 51Y at the time of the refreshing of the seal member 56Y is brought into contact with it from the ridge portions on which the burrs 51*e* are formed, so that rotational resistance of the developing roller 51Y due to the contact of the seal member 56Y becomes larger than that at the time of development. The burrs 51*e* formed on the ridge portions scrape off and remove the toner fixed to the nip portion of the seal member 56Y, like the edge of a knife.

As the timing of the refreshing of the seal member 56Y, the refreshing is carried out when any one of the conditions of a printing time, the number of printing sheets, and the duration time of printing with high printing duty ratio has been reached. Data of each condition of a printing time, the number of printing sheets, and the duration time of printing with high printing duty ratio is stored in a memory section of a printer main body or a memory section built in a toner cartridge, and when each condition has been reached, instructions to perform the refreshing of the seal member 56Y are given to a user. At the time of the exchange of the toner cartridge, the refreshing of the seal member may be automatically performed.

As methods for the treatment of the fixed toner removed by the refreshing of the seal member 56Y, there are two treatment methods.

First, the first treatment method is carried out in a state where a developing bias is applied to the developing roller 51Y at the time of the refreshing of the seal member 56Y. It is to fly and treat the toner removed by the refreshing of the seal member 56Y to the photo conductor 20Y. In this treatment method, the amount of inverse rotation of the developing roller 51Y is set to be from a nip portion of the seal member 56Y and the developing roller 51Y up to a nip portion of the regulating blade 53Y and the developing roller 51Y.

The second treatment method is carried out in a state where a developing bias is not applied to the developing roller 51Y at the time of the refreshing of the seal member 56Y. Out of the fixed toner removed by the refreshing of the seal member 56Y, a portion protruded from the inclined grooves 51*a* and 51*b* is scraped off and removed by the regulating blade. Since at the time of the refreshing of the seal member 56Y, the developing roller 51Y is rotated in the opposite direction to the rotation direction thereof at the time of development, the toner scraped off by the regulating blade 53Y is not returned to the developing chamber 57Y. The toner in the inclined grooves 51*a* and 51*b* is recovered to the developing chamber 57Y by the supply roller 52Y. In the second treatment method, the amount of inverse rotation of the developing roller 51Y is set to be a range being over the contact position of the regulating blade 53Y with the developing roller 51Y, so that the developing roller 51Y is rotated in reverse for a given time without such restriction as in the first treatment method.

Figure 10A:
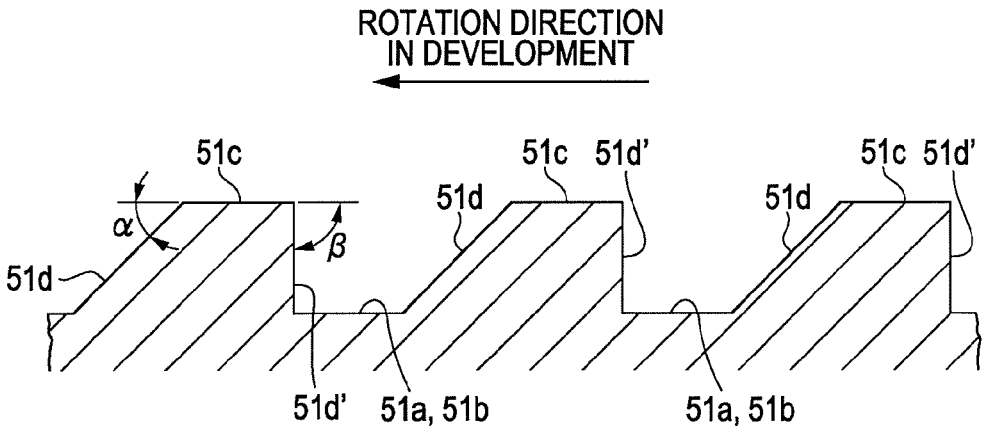
FIGS. 10A and 10B are views showing a state where fixed toner is removed by a difference in an angle that a surface of a convex portion makes with a flank of the convex portion.
Figure 10B:
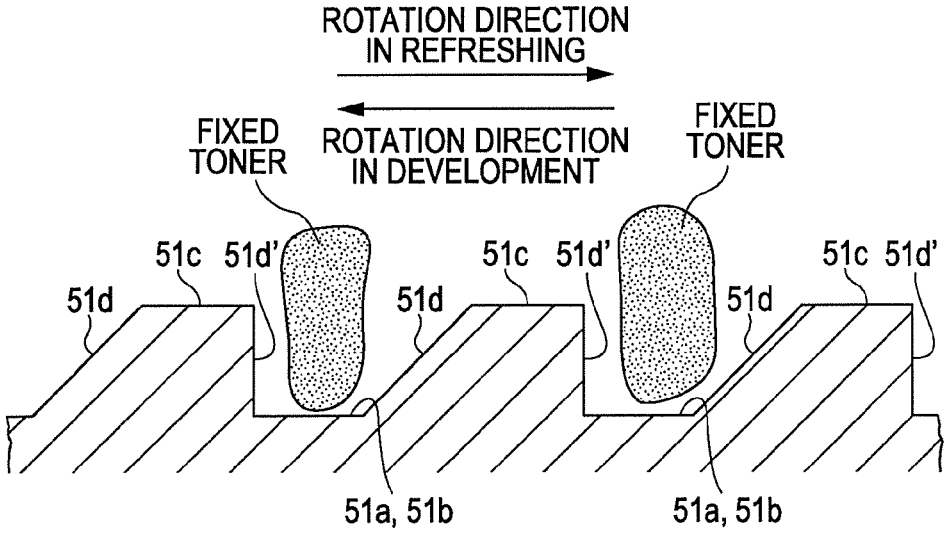

FIGS. 10A and 10B are views showing a second embodiment of the refreshing of the seal member 56Y.

The second embodiment of the refreshing of the seal member 56Y is carried out by using a difference in an angle that the surface of the convex portion makes with the flank 51*d* of the convex portion 51*c*. An angle α which is an outer angle that the surface of the convex portion 51*c* makes with the flank 51*d*, on the downstream side of the rotation direction (the front side of the rotation direction) at the time of development of the developing roller 51Y is formed to be smaller than an angle β which is an outer angle that the surface of the convex portion 51*c* makes with a flank 51*d'*, on the upstream side of the rotation direction (the rear side of the rotation direction) at the time of development. Since the angle α on the downstream side of the rotation direction of the developing roller 51Y at the time of development is small, the seal member which comes into contact with the developing roller 51Y is brought into contact with it from the ridge portion with a small angle α, so that rotational resistance of the developing roller 51Y due to the contact of the seal member 56Y is small.

The shape of the convex portion as shown in FIGS. 10A and 10B can be easily worked by rolling by the cross-sectional shapes of the first inclined blade 201*a* of the first die 201 and the second inclined blade 202*a* of the second die 202 of the rolling apparatus 200 shown in FIG. 6.

For the refreshing of the seal member 56Y, the developing roller 51Y is rotated in the opposite direction to the rotation direction at the time of development. The seal member 56Y which comes into contact with the developing roller 51Y at the time of the refreshing of the seal member 56Y is brought into contact with it from the ridge portion with a large angle β, so that rotational resistance of the developing roller 51Y due to the contact of the seal member 56Y becomes large. The ridge portion with a large angle β removes the toner fixed to the nip portion of the seal member 56Y, by an edge effect.

As the timing of the refreshing of the seal member 56Y, similarly to the first embodiment, the refreshing is carried out when any one of the conditions of a printing time, the number of printing sheets, and the duration time of printing with high printing duty ratio has been reach. Data of each condition of a printing time, the number of printing sheets, and the duration time of printing with high printing duty ratio is stored in a memory section of a printer main body or a memory section built in a toner cartridge, and when each condition has been reach, instructions to perform the refreshing of the seal member 56Y are given to a user. At the time of the exchange of the toner cartridge, the refreshing of the seal member may be automatically performed.

Since the treatment of the fixed toner removed by the refreshing of the seal member 56Y is the same as in the first embodiment, explanation is omitted.

The entire disclosure of Japanese Patent Application No. 2009-034980, filed Feb. 18, 2009 is expressly incorporated by reference herein.

What is claimed is:

1. A developing device comprising:

a developing roller on a surface of which intersecting inclined grooves are formed by rolling working; and a seal member which comes into contact with the developing roller, wherein ridge portions of a convex portion surrounded by the inclined grooves of the surface of the developing roller are formed such that rotational resistance due to the contact of the seal member on the downstream side of a rotation direction opposite to a rotation direction of the developing roller at the time of development is larger that rotational resistance due to the contact of the seal member on the downstream side of a rotation direction of the developing roller at the time of development, at the time of refreshing of the seal member, the developing roller is rotated in the opposite direction to a direction at the time of development, and burrs are formed on the ridge portions of the convex portion on the upstream side of the rotation direction of the developing roller at the time of development.

2. The developing device according to claim 1, wherein the refreshing of the seal member is carried out when at least one of conditions of a given printing time, a given number of printing sheets, a duration time of printing with high printing duty ratio, and a time of exchange of a toner cartridge has been reached.

3. The developing device according to claim 2, wherein data of each of the condition is stored in a memory section of a printer main body or a memory section built in the toner cartridge.

4. The developing device according to claim 1, wherein a range of an inverse rotation of the developing roller in the refreshing of the seal member in a state wherein a developing bias is not applied to the developing roller is set to be a range which is over a contact position of a regulating blade with the developing roller.

5. An image forming apparatus comprising:

a latent image supporting body on which an electrostatic latent image is formed;

a developing device which develops the electrostatic latent image by toner, thereby developing a toner image on the latent image supporting body; and a transfer device which transfers the toner image of the latent image supporting body to a transfer medium, which the developing device is the developing device according to claim 1.

6. A developing device comprising:

a developing roller on a surface of which intersecting inclined grooves are formed by rolling working; and a seal member which comes into contact with the developing roller, wherein ridge portions of a convex portion surrounded by the inclined grooves of the surface of the developing roller are formed such that rotational resistance due to the contact of the seal member on the downstream side of a rotation direction opposite to a rotation direction of the developing roller at the time of development is larger that rotational resistance due to the contact of the seal member on the downstream side of a rotation direction of the developing roller at the time of development, at the time of refreshing of the seal member, the developing roller is rotated in the opposite direction to a direction at the time of development, and a range of an inverse rotation of the developing roller in the refreshing of the seal member in a state where a developing bias is applied to the developing roller is set to be from a contact position of the seal member with the developing roller up to a contact position of a regulating blade with the developing roller.

* * * * *